US005538244A

United States Patent [19]

Gibert

[11] Patent Number: 5,538,244

[45] Date of Patent: Jul. 23, 1996

[54] VIBRATION ABSORPTION DEVICE

[75] Inventor: Xavier Gibert, La Mulatiere, France

[73] Assignee: Babolat VS, Lyon, France

[21] Appl. No.: 281,516

[22] Filed: Jul. 28, 1994

[51] Int. Cl.[6] ..... A63B 51/10

[52] U.S. Cl. ..... 273/73 D; 273/73 R; 273/73 A; 273/73 E

[58] Field of Search ..... 273/73 D, 73 C, 273/73 G, 73 R, 73 E, 73 A; 84/216, 315, 318

[56] References Cited

U.S. PATENT DOCUMENTS

| | | | |
|---|---|---|---|
| 4,589,662 | 5/1986 | Robaldo | 273/73 D |
| 4,609,194 | 9/1986 | Krent et al. . | |
| 4,732,383 | 3/1988 | Ferrari et al. . | |
| 4,776,590 | 10/1988 | Krent et al. . | |
| 5,141,228 | 8/1992 | Soong | 273/73 D |
| 5,149,090 | 9/1992 | Chen et al. | 273/73 D |
| 5,211,397 | 5/1993 | Davis et al. | 273/73 D |
| 5,222,998 | 6/1993 | Ferrari et al. | 273/73 D |

FOREIGN PATENT DOCUMENTS 0497561 8/1992 European Pat. Off. .

*Primary Examiner*—V. Millin
*Assistant Examiner*—Charles W. Anderson
*Attorney, Agent, or Firm*—Oliff & Berridge

[57] ABSTRACT

A vibration reducing device for a sports racket made up of a one-piece flexible elongated block includes at least one elastically compressible viscoelastic material, the block having first and second end faces, a front face and rear face, at least three blind slots distributed along the block. Each of the slots extends substantially perpendicularly to the elongate block from the front face and terminates opposite the front face in a channel passing through the block parallel to the front and rear faces. The channels have cross dimensions adapted to receive a string, the blind slots thus dividing the block into at least two divisions, each division having, in its unconstrained form, a longitudinal dimension greater than the spacing gap between two corresponding parallel strings that enter respectively two channels on either side of the division.

19 Claims, 2 Drawing Sheets

VIBRATION ABSORPTION DEVICE

BACKGROUND

The invention relates to a vibration absorbing and reducing device for strung sports rackets, wherein the device is mountable on the racket and comprises an elongate flexible block of viscoelastic material having absorption and vibration reducing characteristics.

Contemporary sports rackets are often made of synthetic or metallic materials as opposed to wood. These constructions have brought about advantages in lightness, power transmission and maneuverability for the player to the detriment of the vibration absorbing and reducing capabilities on impact of a projectile, such as a ball, that the player used to have with wooden rackets.

In order to remedy this problem several solutions have been proposed, for example, vibration absorbing frame inserts, frames made of particular synthetic materials having improved shock absorbing or dissipating properties, and absorbing devices which are applied to the strings of a racket. The latter type of device has been particularly developed in recent years since in theory it permits adjustment of the racket to each user's own particular preferences.

An example of the latter device is illustrated in U.S. Pat. Nos. 4,776,590 and 4,609,194 to Krent, and is described as a cylindrical block of foam which is inserted between two adjacent parallel strings. Upon insertion, the block assumes a generally spherical shape and thereby engages four adjacent strings of both sets of strings or three adjacent strings and the racket frame.

An alternative approach to this particular problem has been described in U.S. Pat. No. 4,732,383 to Ferrari et al. The device of this patent consists of a bar or strap of between five to ten inches in length designed to absorb shock and vibration. In use, the bar is woven over and under the vertical strings in the region between the handle and nearest cross or horizontal string. The ends of the bar are brought through the end spaces between the string and the frame of the racket and tucked under the frame. The bar is comprised of layers of varying frequency absorbing material, the inner layers having a higher density than the outer layer.

Various modifications on this idea have been considered, involving, for instance, the fixing of the ends of the bar or strap using appropriate means, such as hooks or loops, or providing a plurality of transversally extending external spaced ribs, as in the EP patent application No. 0,497,561 to Ool et al., wherein the ribs define stops for locating the strap positively with respect to the longitudinally extending strings, the latter arrangement preventing the strap from shifting laterally during play.

The problem with the abovementioned prior solutions is that none of them completely and effectively grip the strings around their entire circumference. Therefore, they do not procure optimal absorption and reduction of vibrations and energy transmitted via the strings to the player.

SUMMARY OF THE INVENTION

Accordingly, it is an object of the invention to provide a device for a sports racket which efficiently reduces the vibrational energy transmitted by the striking of an object with the racket.

Another object of the invention is to provide a vibration reducing device for a sports racket which tightly encompasses one or more strings of the racket on all sides, thereby efficiently reducing the vibrations which would otherwise be transmitted to the player.

The term "absorption of vibrations" used in this specification means that the device is capable of reducing both the frequency of the vibration imparted to the strings when a ball is hit as well as absorbing the energy transmitted.

Accordingly, the present objects of the invention are met by providing a vibration reducing device for a sports racket, wherein the racket includes a frame to which a handle portion is joined, a plurality of spaced apart interwoven transverse and axial strings defining a striking surface secured to the frame, and the device comprises:

a one-piece flexible elongated block having a longitudinal dimension, comprised of at least one viscoelastic material, elastically compressible at least along the longitudinal dimension;

the block having first and second end faces along the longitudinal dimension, a longitudinal front face, and a longitudinal rear face, at least three blind slots distributed along the longitudinal dimension of the block, each slot extending substantially perpendicularly to the longitudinal dimension from the front face and terminating opposite the front face in a channel passing through the block parallel to the front and rear faces, and having cross dimensions adapted to receive a string, the blind slots thus dividing the block into at least two divisions, each division having, in its unconstrained form, a longitudinal dimension greater than the spacing gap between two corresponding parallel strings entering respectively two channels on either side of the division, whereby the block is adapted to be secured to the striking surface by engaging at least three parallel and consecutive strings respectively in the three blind slots, until they enter the respectively corresponding channels, the block being thus compressively constrained along the longitudinal dimension, while the channels tightly grip said parallel strings.

The objects of the invention are also met by providing a block as above which also has at least one lateral top and bottom face.

The term "longitudinal dimension" used above and hereafter in the present description and claims refers to the length of the vibration reducing device along the direction of elongation of the block.

The term "unconstrained form" used herein refers to the form adopted by the vibration reducing device, in this case the block, when it is, for example, not mounted on the sports racket and held by compression thereon. The block of viscoelastomeric material in its unconstrained form therefore assumes a shape corresponding to that resulting from the moulding process.

In this specification, the terms "front face", "rear face", "top face" and "bottom face" will be explained as follows:

the front face refers to the side of the block in which has been provided the plurality of blind slots, wherein said slots traverse the entire height of the front face;

the rear face is consequently the lateral face situated opposite the front face;

the top and bottom faces are consequently the faces adjacent and extending between the front and rear faces.

According to this definition, the front and rear faces have a height perpendicular to the longitudinal dimension, and the top and bottom faces have a width, or depth (as seen from the front face), perpendicular to both of the latter dimensions.

Further, the height of at least one front or rear lateral face of the block may increase from each end face towards a point of the at least one front or rear lateral face situated between the two end faces.

Additionally, the width of at least one top or bottom lateral face of the block may increase from each end face towards a point of the at least one top or bottom lateral face situated between the two end faces.

The block may generally have any shape and any number of faces, for example it may be oblong, cylindrical, ellipsoid, cuboid or a combination thereof along its longitudinal dimension.

Preferably, the block has an approximately oblong shape and is of square or rectangular cross section.

The viscoelastic material used to make the block can be chosen from any suitable material such as natural or synthetic rubbers, for example, chlorinated rubber, and various natural or synthetic polymers, such as polyvinylchloride, high density cellular urethane, butyl rubber, acrylonitrile-butadiene elastomer, epoxidised natural rubber, polynobornene, styrene butadiene rubber, silicone polymers such as Very High Damping Silicone (VHDS), and the like, or mixtures of any of the above.

Preferably, the viscoelastic material used to make the block is comprised of VHDS and has a Shore Hardness of between about 35 to about 40 shore A. The block is formed from the above viscoelastic materials by any of the well known molding techniques.

Advantageously, the mass of the block is generally from about 2 to about 10 grams, preferably comprised from about 4 to about 6 grams.

Preferably, the slots mentioned above terminate in channels substantially at mid depth of said block, wherein the "depth" is herein defined as the dimension perpendicular to both the longitudinal dimension and the height of the front face.

DESCRIPTION OF THE DRAWINGS

In the drawings which illustrate more concretely the presently contemplated invention.

DESCRIPTION OF THE PREFERRED EMBODIMENTS OF THE INVENTION

Figure 1:
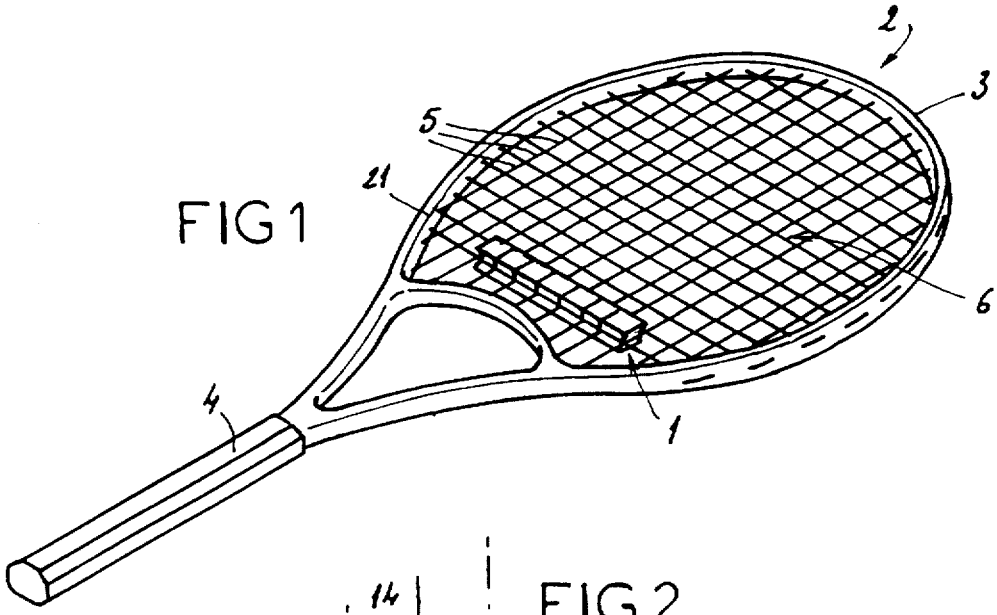
FIG. 1 is a perspective view of a typical sports racket with the vibration reducing device of the invention mounted thereon.
Figure 2:
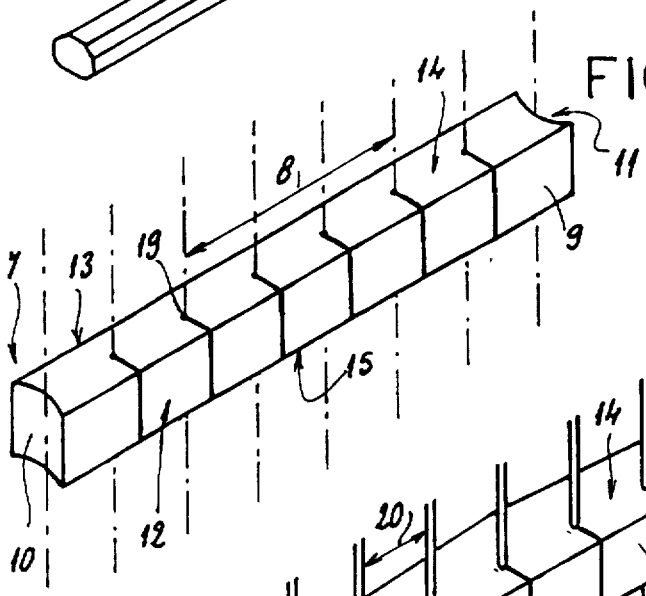
FIG. 2 is an enlarged perspective view of a vibration reducing device according to the invention in its free, that is to say unmounted, and relaxed state.

Referring now to the drawings, and in particular to FIGS. 1 and 2, the vibration reducing device as embodied in the invention is indicated generally at 1. This device is mounted on a typical sports racket 2. The racket 2 includes a frame 3 to which a handle portion 4 is joined; the racket frame 3 has a plurality of spaced apart interwoven transverse and axial strings 5, defining a striking surface 6, secured to the frame 3. The periphery of the striking surface 6 is defined by a racket head edge face 21.

The device comprises a one-piece flexible elongated block 7 having a longitudinal dimension extending into the directions indicated by the arrow 8 and comprised of Very High Damping Silicone (VHDS) 9 elastically compressible along the longitudinal dimension.

The block 7, according to FIGS. 1 and 2, has a substantially square transverse cross section, more preferably a substantially rectangular transverse cross section, and the mass of the block is preferably from about 4 to about 6 grams.

Referring again to FIG. 2, the block 7 delimits at least a first and second end face 10,11, a front and rear face 12,13, and a lateral top and bottom face 14,15.

Figure 3:
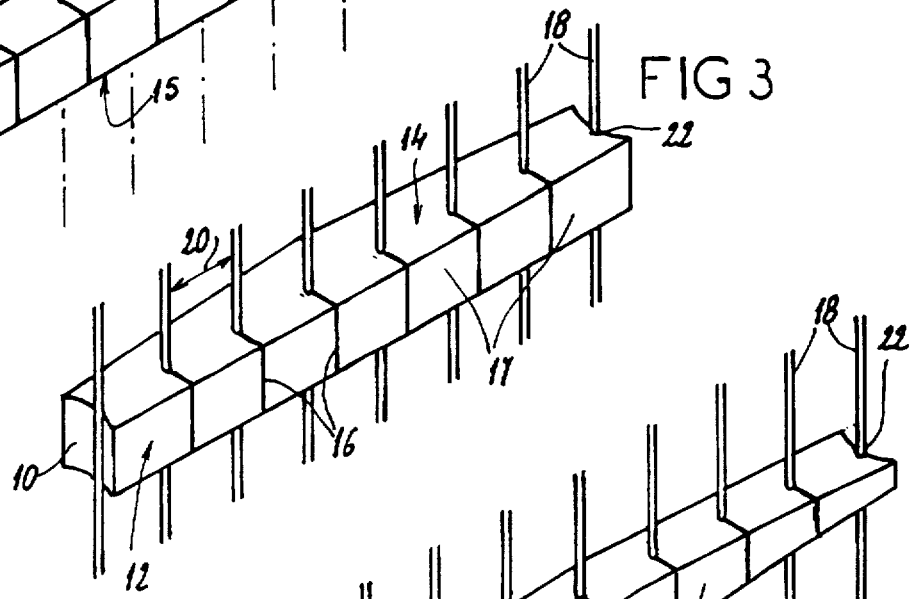
FIG. 3 represents a similar perspective view of a preferred embodiment of the contemplated vibration reducing device of the invention, mounted on several strings of a sports racket.
Figure 4:
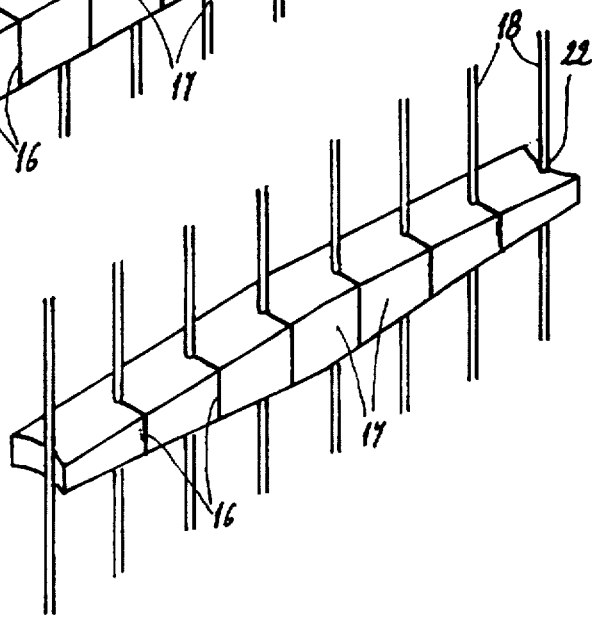
FIG. 4 represents a perspective view of yet another preferred embodiment of the contemplated vibration reducing device of the invention, again in its mounted or compressed position, on several strings of a sports racket.

As shown in particular by FIGS. 3 and 4, which represent possible variants of the shape of block 7 according to the invention, when compression forces are exerted on the end faces 10,11, the block 7 is compressively constrained along the longitudinal dimension 8, whereby the end faces 10,11 approach each other and the block 7 adopts a constrained conformation.

The block 7 further includes a plurality of blind slots 16 distributed along the longitudinal dimension 8 of the block 7, but perpendicularly to said longitudinal dimension 8, i.e. along the height of the front face. The slots 16 penetrate the block from the front face 12, as mentioned above, thus wholly or partially dividing the block 7 on at least three of its faces 12,14,15 into a plurality of cube-like shaped divisions 17 in order to permit the introduction of parallel strings 18 therein when the block 7 is mounted on the racket.

The slots 16, as described above, terminate at mid-depth within said block 7 in a corresponding plurality of channels 19 parallel to the slots 16, and also perpendicular to the longitudinal dimension 8. The channels 19 pierce the block 7 completely and traverse the block 7 from the at least one top lateral face 14 through to the at least one bottom lateral face 15.

Additionally, the channels 19 may preferably be of a diameter smaller than that of the strings 18 of the sports racket 2 thereby procuring a pregrip effect completely surrounding the strings 18 by the viscoelastic material 9 of the block 7 when it is mounted on the racket, but before it is constrained by applying force to each of the end faces 10,11.

Each cube-like division 17 in the block 7 has a longitudinal dimension greater than the spacing gap 20 between two parallel strings 18 or that between an end string 18 and a racket head edge part 21.

Optionally, each end face 10,11 adjacent a first one of the channels 19 defines a cube-like division 17 of greater longitudinal dimension than the spacing gap 20 between two parallel strings 18 or that between an end string 18 and a racket head edge part 21.

The surprising result of the above combination, as illustrated for example in FIGS. 3 and 4, is that the size and shape of the divisions 17, slots 16 and channels 19 adapt to permit the introduction of the strings 18 when the end faces 10,11 of the block 7 are not compressed. Thus, the divisions 17 are put under constraint by the fact that their longitudinal dimensions are greater than the spacing gap 20 between two parallel strings 18.

FIGS. 3 and 4, in addition to showing how the block 7 adapts to being mounted on the strings 18, also show different shapes for the block 7. FIG. 2 shows a block 7 having front, rear, top and bottom faces 12,13,14,15 that all have a substantially rectangular shape. FIG.3 shows a block 7 in which the top and bottom faces 14,15 have less width or depth at each end and have a greater width or depth at a midpoint of their edges extending along the longitudinal dimension. Further, the depth varies at each point between the ends and the center point. FIG.4 shows a block 7 wherein the front and rear faces 12,13, rather than the top and bottom faces 14,15, are shaped as described with respect to the top and bottom faces of FIG.3.

Furthermore, when the end faces 10,11 are also compressed by a parallel string 18 exterior to those entrapped by the block 7 or by a racket head edge part 21, the constraint formed by the divisions 17, slots 16 and channels 19 is further increased and completely blocks or tightly grips circumferentially the parallel strings 18 inserted in the channels 19 via the slots 16.

The invention is further supported by the following example:

A viscoelastic material comprised of VHDS (Very High Damping Silicone), was molded into a device similar to that illustrated in FIG. 2. The device was subjected to tests to measure its vibration reducing capabilities by simulating conditions that would normally be encountered in a typical tennis match. The experimental protocol involved is detailed hereafter.

Figure 5:
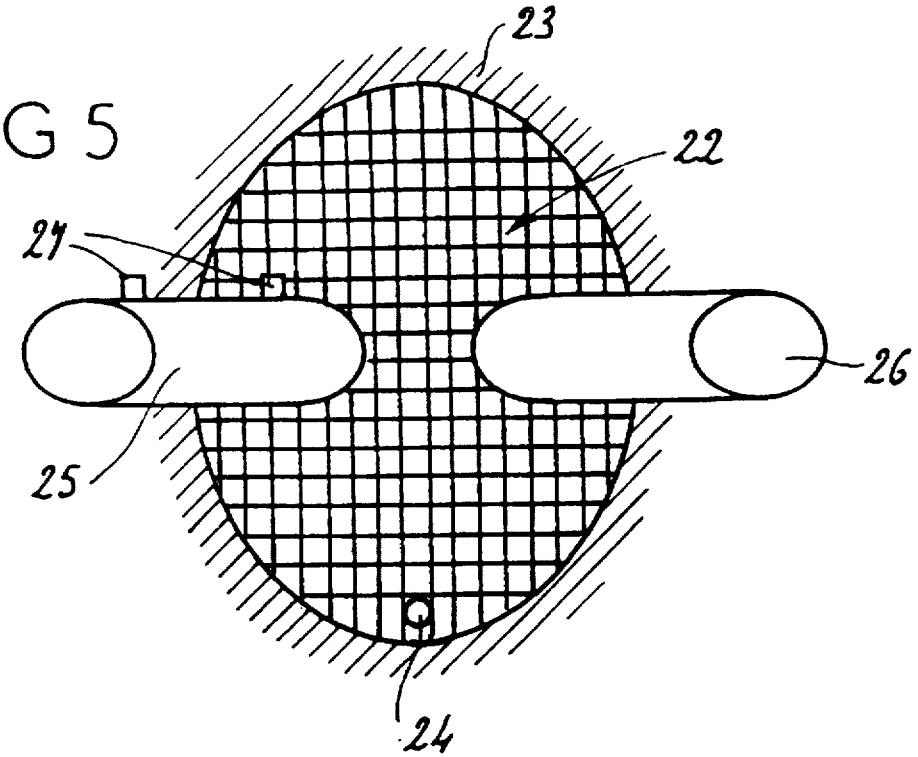
FIG. 5 is a frontal schematic representation of the test apparatus used for measuring the reduction in vibration obtained by the device according to the invention.

In order to quantify the efficiency of vibration reducing devices according to the invention, the inventors have used a comparison of the acceleration responses measured on impact of a ball on a racket string mesh as schematically shown in FIG. 5.

Figure 6:
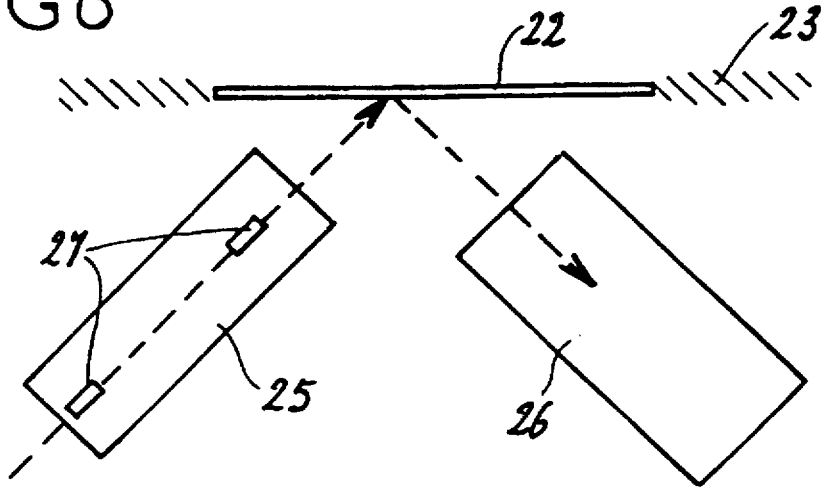
FIG. 6 is a top plan view of the test apparatus represented by FIG. 5.

This figure shows a racket string mesh 22, mounted in a supporting frame 23. An accelerometer 24 is placed and fixed to the string mesh in proximity to the generally intended placement of the vibration reducing device. The device itself may be placed anywhere on the racket strings but in no case touches the accelerometer. Generally, the device is placed in the vicinity of the handle end of the racket for maximum player comfort. In this example, as shown in FIG. 5, the accelerometer 24 was fixed below the first transverse string of the racket and centrally along the supporting frame's longitudinal axis. The accelerometer 24 is fixed in such a way that it covers two adjacent parallel axial strings. An air cannon 25 for firing balls at the string mesh 22 is mounted opposite a ball recovery tube 26, such that when a ball is fired at the mesh it rebounds and is captured by the recovery tube. The cannon also comprises two photoelectric cells 27 spaced apart at a known distance. This is more clearly demonstrated by FIG. 6, which shows the trajectory of the ball from a top plan view.

In operation, a ball is fired down the cannon barrel 25 by air pressure release and the speed of the ball controlled by providing a rubber membrane inside the barrel through which the ball passes (not shown). The rigidity of the rubber membrane determines the speed of the ball on exit from the barrel. The average speed of the ball in these tests was between 91 and 93 km/h as measured by the two photoelectric cells 27. The cells are set apart at a distance of 0.5 meters, the first of the two serving to initialise the accelerometer 24. The accelerometer 24 emits a signal which is processed by a conditioner whose output is linked to a signal analyser (HP 3562A) enabling temporal or frequential analysis.

In the present example frequential analysis was carried out on both synthetic and gut string meshes with and without (reference control) the abovementioned vibration reducing device, after calibration of the measuring apparatus, and at three different tensions. It was found that the vibration reducing device according to the invention noticeably reduced vibrations in the range of frequencies comprised between about 600 and about 2500 Hz.

What is claimed is:

1. A vibration reducing device for a sports racket, wherein the racket includes a frame to which a handle portion is joined, a plurality of spaced apart interwoven transverse and axial strings defining a pretensioned striking surface secured to the frame, said vibration reducing device being intended to be removably mountable on a striking surface of a racket and comprising:

a one-piece flexible elongated block having a longitudinal dimension and comprised of at least one viscoelastic material, elastically compressible at least along the longitudinal dimension, said block having first and second end faces at ends of the longitudinal dimension, a longitudinal front face, a longitudinal rear face, a longitudinal top face, and a longitudinal bottom face, and at least three blind slots distributed along the longitudinal dimension of said block, each said slot extending perpendicularly to said longitudinal dimension from said front face and terminating between said front face and said rear face in a straight channel passing through said block parallel to said front and rear faces from said top face to said bottom face, each said channel adapted to receive a string, said blind slots thus dividing the block into at least two divisions, each division having, in its unconstrained form, a longitudinal axis dimensioned to be greater than the spacing gap between two corresponding parallel strings that would enter respectively two channels on either side of said division when the block is to be mounted on a racket, whereby said block is adapted to be secured to a striking surface by engaging at least three parallel and consecutive strings respectively in said three blind slots, until the strings enter the respectively corresponding channels, said block being thus compressively constrained along said longitudinal dimension such that said channels are reduced about 360° to tightly grip the parallel strings around an entire circumference of the strings.

2. The device according to claim 1, wherein each said end face immediately adjacent a channel defines an end division of greater longitudinal dimension than the spacing gap between two parallel strings or that between an end string and a racket head edge part.

3. The device according to claim 1, wherein the divisions all have a cube-like shape.

4. The device according to claim 1, wherein each said slot terminates in a channel substantially at mid-depth of said block.

5. The device according to claim 1, wherein said block has a substantially square transverse cross section.

6. The device according to claim 1, wherein said block has a substantially rectangular transverse cross section.

7. The device according to claim 1, wherein the height of at least one front or rear face of the block increases from each end face towards a point of at least one front or rear face situated between the first and second end faces.

8. The device according to claim 1, wherein the width of said block increases from each end face towards a point of at least one top or bottom lateral face situated between the first and second end faces.

9. The device according to claim 1, wherein said block has a mass of from about 2 grams to about 10 grams.

10. The device according to claim 1, wherein each of the two end faces is provided with a locating groove for locating an exterior string.

11. The device according to claim 1, wherein the at least one viscoelastic material comprising said block has a Shore Hardness of about 35 to about 40 shore A.

12. A vibration reducing device for mounting to pretensioned strings of a sports racket, said vibration reducing device being intended to be removably mountable on a striking surface of a racket and comprising:

an oblong block;

at least three slits extending substantially halfway into said oblong block from a face of an elongated side of said oblong block; and at least three straight channels passing through said oblong block from an upper face to a lower face and defining a terminal edge for each one of said at least three slits, wherein said oblong block is engaged on either end by racket strings and additional racket strings are entered into and seated in said channels when the oblong block is to be mounted on a racket via said slits via compression on each end of the oblong block to provide longitudinal compression of said oblong block such that said channels are reduced to tightly grip the strings completely around an entire circumference of the strings.

13. The vibration reducing device according to claim 13, wherein each of said at least three slits terminates in a corresponding one of said at least three channels.

14. The vibration reducing device according to claim 12, wherein each said end of said oblong block has a groove for engaging the strings of the sports racket.

15. The vibration reducing device according to claim 12, wherein said oblong block has a substantially rectangular cross section.

16. The vibration reducing device according to claim 15, wherein a width of said oblong block increases from each end toward a midpoint of a longitudinal direction of said oblong block.

17. The vibration reducing device according to claim 15, wherein a height of said oblong block increases from each end to a midpoint of a longitudinal axis of said oblong block.

18. The vibration reducing device according to claim 12, wherein said oblong block is made of a viscoelastic material.

19. The vibration reducing device according to claim 18, wherein said oblong block has a Shore Hardness of about 35 to about 40 shore A.

* * * * *